US006301845B1

(12) United States Patent
Milanian

(10) Patent No.: US 6,301,845 B1
(45) Date of Patent: Oct. 16, 2001

(54) AMUSEMENT AND VIRTUAL REALITY RIDE

(76) Inventor: Cyrus Milanian, 2070 SE. 16th St., Pompano Beach, FL (US) 33062

( * ) Notice: Subject to any disclaimer, the term of this patent is extended or adjusted under 35 U.S.C. 154(b) by 0 days.

(21) Appl. No.: 09/250,964

(22) Filed: Feb. 16, 1999

Related U.S. Application Data

(63) Continuation-in-part of application No. 09/184,603, filed on Nov. 2, 1998, now Pat. No. 6,073,403.

(51) Int. Cl.[7] ..... E04H 1/00
(52) U.S. Cl. ..... 52/236.1; 472/59
(58) Field of Search ..... 472/60, 59, 61, 472/130; 52/236.1, 79.1

(56) References Cited

U.S. PATENT DOCUMENTS

| | | | | |
|---|---|---|---|---|
| 797,095 | | 8/1905 | Boyce . | |
| 817,577 | | 4/1906 | Miller . | |
| 872,627 | | 12/1907 | Keen . | |
| 5,219,315 | | 6/1993 | Fuller et al. . | |
| 5,282,772 | * | 2/1994 | Ninomiya | 472/59 |
| 5,336,132 | | 8/1994 | Murakami . | |
| 5,669,821 | | 9/1997 | Prather et al. . | |
| 5,846,134 | * | 12/1998 | Latypov | 472/130 |
| 5,857,917 | * | 1/1999 | Francis | 472/60 |
| 5,865,624 | * | 2/1999 | Hayashigawa | 472/60 |
| 5,964,064 | * | 10/1999 | Goddard | 52/8 |
| 6,007,338 | * | 12/1999 | DiNunzio | 472/59 |
| 6,017,276 | * | 1/2000 | Elson | 472/60 |

* cited by examiner

*Primary Examiner*—Beth A. Stephan
(74) *Attorney, Agent, or Firm*—Oltman, Flynn & Kubler

(57) ABSTRACT

This invention includes means, apparatus and devices for performing the steps of the method described above, such as for example, wide angle image projection apparatus for projecting wide angle images for the enactment of a sail; sound projection apparatus for creating sound elements of the virtual reality in at least two directions, synchronized with the image projection apparatus; means for creating olfactory elements of the virtual reality synchronized with the image projection apparatus; and means for creating hot air and cold air synchronized with the image projection apparatus; and furthermore, wide angle screen means juxtaposed with the wide angle projection apparatus for displaying the wide angle images, the wide angle screen means having a focal region within view of the projected images; seating means disposed in the focal region for seating viewers of the images, the focal region being exposed to the elements of virtual reality, including the olfactory elements, and the hot air and cold air. The apparatus according to the invention may further include wide angle image projection apparatus, wherein the wide angle is up to a 360° in a horizontal plane, and the wide angle image projection apparatus, including upward directed projection means for projecting overhead images of the enactment, synchronously coupled to the wide angle projection apparatus. The apparatus according to the invention may further include digital signal detection means coupled to digital image projection apparatus operative for receiving digital control signals embedded in the projected digital images, the digital control signals being operative for digitally controlling functions of at least one of the means for creating the olfactory elements of virtual reality.

6 Claims, 8 Drawing Sheets

AMUSEMENT AND VIRTUAL REALITY RIDE

This application is a continuation-in-part of Ser. No. 09/184,603 filed Nov. 2, 1998, now U.S. Pat. No. 6,073,403 dated Jun. 13, 2000 based on provisional application No. 60/065,354 filed Feb. 20, 1998 and disclosure document #431703 filed Feb. 21, 1998.

The invention relates to an amusement and virtual reality ride, and more particularly to a method and apparatus for enacting a ship at sea, the ship impacting an iceberg, and the ship sinking after impacting the iceberg. The ride may also include an enactment of an underwater ride to the sunken ship. The method may further include an enactment of a dive through the ocean and a view of the sunken ship resting on the sea bottom.

BACKGROUND OF THE INVENTION AND KNOWN ART

Recent years have seen an evolution of enactments of happenings and events of more than ordinary interest.

The field of creating and/or re-enacting such sensations of reality has become known as the field of "virtual reality".

A related development has led to the creation of so-called theme parks, wherein participants are treated to enactments of happenings of more than ordinary interest, often times as enactments of historical events, sometimes in futuristic settings, sometimes in historical or pre-historic settings, and at other times as settings of pure fantasy.

It is accordingly a primary object of the present invention to expand the concept of virtual reality to further enhance the concept of virtual reality by adding new effects and elements thereto as described in more detail below.

It is a further object of the present invention to apply the concept of the above enhanced virtual reality to an enactment of the sinking of the ocean liner Titanic.

It is another object of the invention to apply the present enhanced concept of virtual reality to an enactment of a travel from the ocean surface to the wreck of the ocean liner Titanic now resting on the sea bottom in the northern Atlantic Ocean.

SUMMARY DESCRIPTION OF THE INVENTION

The invention relates to a method for enacting an ocean sail of a ship using elements of virtual reality, the method which comprises the steps of enacting the ship departing a port of embarkation, enacting the ship crossing a body of water, enacting the ship impacting an iceberg, enacting the ship sinking and enacting rescue efforts of surviving passengers and crew.

The method further includes the step of forming the ship in likeness of the ocean liner Titanic, including the step of forming the iceberg in likeness of the iceberg that impacted the ocean liner Titanic.

The method further includes forming elements of virtual reality, such as elements of visual, acoustic, olfactory, tactile, physical motion and temperature reality.

The method may additionally include the steps of forming an element of visual reality by means of wide angle image projection apparatus for projecting images of the enactment in rapid succession, creating an illusion of live motion, and forming the element of acoustic reality by means of sound apparatus synchronized with the projection apparatus. In particular, the element of acoustic reality includes sound effects projected from any direction in the space above and from below the ground plane. The sound effects may further include enhanced echo effects.

The method according to the invention may further include the steps of forming elements of olfactory reality by means of air-moving apparatus synchronized with the projection apparatus, and drawing the air from smell-generating sources.

The method according to the invention may additionally include steps of forming the element of temperature reality by means of air-moving apparatus, synchronized with the projection apparatus, and drawing the air from air-heating, air-cooling and air pressure controlling sources.

The method according to the invention can further include steps of controlling the acoustic, olfactory, temperature, visual and physical motion virtual reality elements by means of cues embedded in an electronic memory being scanned in synchronism with the image projection apparatus.

The method according to the invention may further include the step of forming the element of visual virtual reality as a three dimensional image, projecting the image on a three dimensional image screen, and forming the element of acoustic virtual reality as a three dimensional sound signal.

The inventive concept may further include polarizing the images into complementary polarized images being polarized at respective 90° angles to each other, forming a viewing area within a focal region of the three dimensional image screen, and providing a seating facility for at least one person within the focal region.

The invention may additionally include a method of agitating the seating facility and controlling the agitating by means of cues embedded in the aforesaid computer memory.

The invention further includes means, apparatus and devices for performing the steps of the method described above, such as for example, wide angle image projection apparatus for projecting wide angle images for the enactment of a sail; sound projection apparatus for creating sound elements of the virtual reality in at least two directions, synchronized with the image projection apparatus; means for creating olfactory elements of the virtual reality synchronized with the image projection apparatus; and means for creating hot air and cold air synchronized with the image projection apparatus; and furthermore, wide angle screen means juxtaposed with the wide angle projection apparatus for displaying the wide angle images, the wide angle screen means having a focal region within view of the projected images; seating means disposed in the focal region for seating viewers of the images, the focal region being exposed to the elements of virtual reality, including the olfactory elements, and the hot air and cold air.

The apparatus according to the invention may further include wide angle image projection apparatus, wherein the wide angle is up to a 360° in a horizontal plane, and the wide angle image projection apparatus, including upward directed projection means for projecting overhead images of the enactment, synchronously coupled to the wide angle projection apparatus.

The apparatus according to the invention may further include digital signal detection means coupled to digital image projection apparatus operative for receiving digital control signals embedded in the projected digital images, the digital control signals being operative for digitally controlling functions of at least one of the means for creating the olfactory elements of virtual reality.

The invention may further include forming a likeness of the sunken ship resting on a sea bottom; forming a tubular person passage to the likeness of the sunken ship, the tubular passage having walls being at least in places of transparent material for enabling a view of at least the sunken ship, and a view of sea life around the sunken ship.

The invention may further include an apparatus wherein the focal region includes sound damping elements for dampening inherent local echoes created in the focal region.

The apparatus preferably includes a control and sound strip synchronously coupled to the projection apparatus, the control and sound strip having a plurality of sound tracks for generating sound effects stored on the sound tracks, a clock track having control clock elements, and a frame identity track including an image frame identity number specific to each image frame embedded in the frame identity track.

The invention may further include frame alignment means coupled to the frame identity track for aligning frames of same identity to the frame identity track.

The image and sound projection apparatus may additionally include means for generating elements of virtual reality, comprising at least one image projector for projecting a plurality of serially connected image frames disposed on a respective image strip; at least one sound projector for reading an equal plurality of serially connected sound frames disposed on a respective sound strip in synchronism with the image frames, wherein the image frames and the sound frames are mutually paired by means of identical frame identity numbers disposed on each pair of image and sound frames; frame identity number reading and synchronizing means coupled to each image and sound projector for maintaining the image and sound projector in frame synchronism; and virtual reality element generating means coupled to the frame identity number reading means for generating elements of virtual reality in synchronism with the image and sound frames.

The image and sound projection apparatus according to the invention may include a plurality of image projectors, each arranged to project a part of a total image by means of a respective image strip, each image strip composed of a plurality of serially connected image frames, each image frame having a frame identity number track identifying each frame with a sequentially incremented frame number.

The image and sound projection apparatus according to the invention may further include frame numbers which are binary numbers disposed on a continuous number track extending lengthwise on each image strip, and wherein equally numbered image frames together form a contiguous projected moving image, and wherein each binary frame identity number begins with a frame start bit followed by at least one counting bit, wherein the plurality of the counting bits is sufficient to identify the highest numbered frame in a complete series of image frames, and wherein the frame start bit is longer than the counting bits.

The image and sound projection apparatus according to the invention may further include on the sound strip a continuous clock track composed of clock bits arranged in a continuous sequence of clock bits in longitudinal alignment with the counting bits, and wherein further each of the sound frames includes a plurality of continuously connected sound tracks, each sound track being recorded from sounds coming from different directions so as to form in combination an omni-directional sound impression.

The image and sound projection apparatus according to the inventive concept, preferably includes a viewing location for an audience of at least one person, and seating facilities in the viewing location for accommodating the person, wherein the seating facilities are disposed in a focal area of the viewing location.

The image and sound projection apparatus according to the inventive concept preferably includes a drive motor for each of the image and sound projectors, and synchronizing means for maintaining the image and sound strip in synchronism, wherein the synchronizing means includes reading means for reading the frame identity numbers, comparison means for comparing the frame identity numbers, and motor speed control means coupled to the comparison means for maintaining the image and sound strips in synchronism.

The image and sound projection apparatus according to the invention may include virtual reality element control means having at least means for controlling air temperature, olfactory control means, tactile control means, air pressure control means and echo control means, and wherein the virtual reality element control means include a computer having an input coupled to the frame identity number reading means for continuously reading the frame identity numbers, wherein each of the virtual reality elements has assigned thereto a given frame identity number for enacting a respective virtual reality sub-routine by means of the computer, and wherein the computer has outputs coupled to virtual reality enacting facilities for activating corresponding virtual reality sub-routines. Furthermore, the computer includes a dedicated memory dedicated to storing a plurality of virtual reality subroutines, each subroutine having a specific subroutine address cross-correlated with a corresponding frame identity number.

Further objects and advantages of this invention will be apparent from the following detailed description of a presently preferred embodiment, shown schematically in the accompanying drawings.

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENTS

Figure 1:
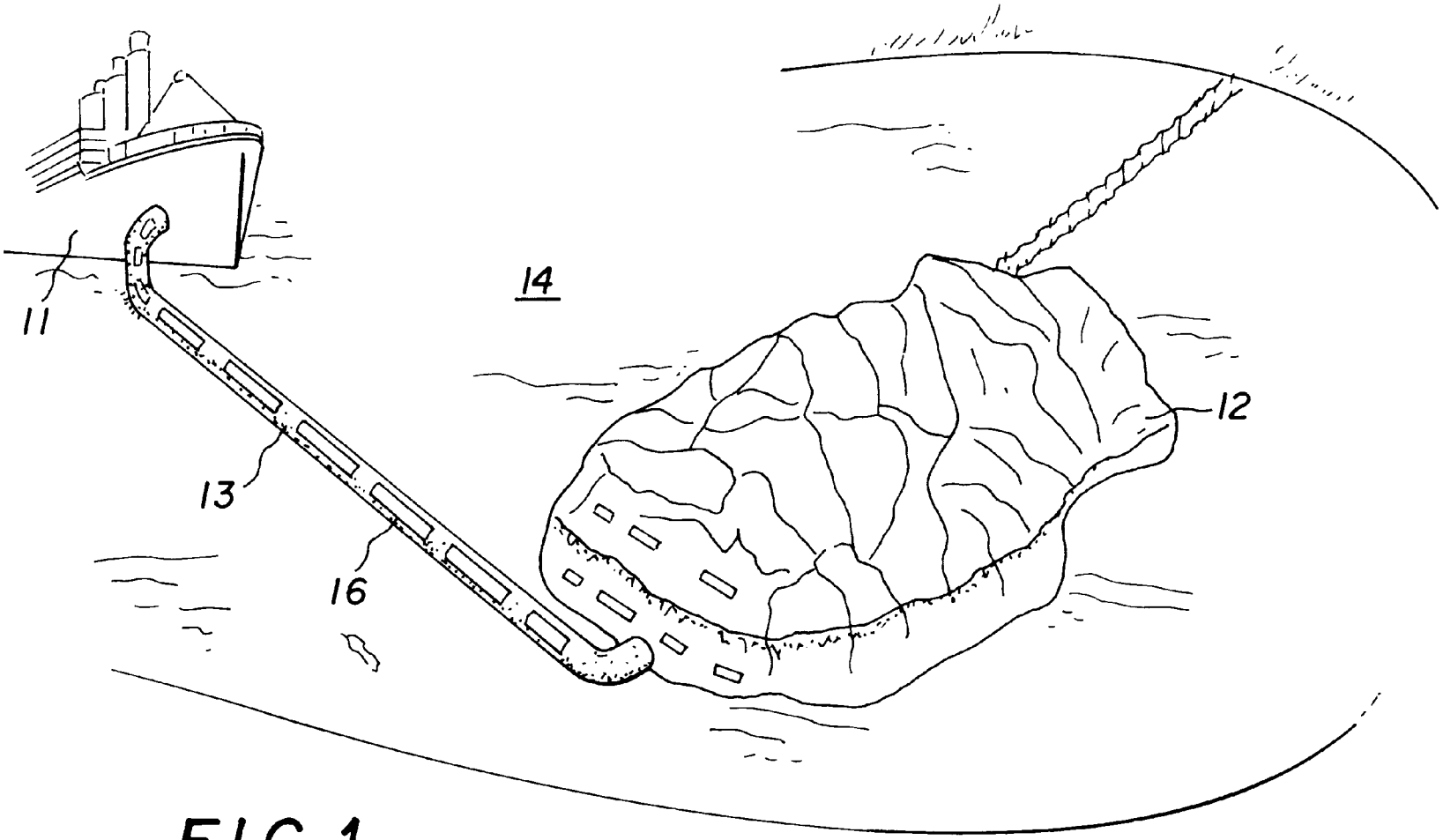
FIG. 1 is a perspective view of an ocean liner, an iceberg, a lake and an underwater person passage between the ocean liner and the iceberg.

FIG. 1 shows a likeness 11 of an ocean liner, in particular the ocean liner Titanic, immediately prior to its impact with a likeness of the iceberg 12.

In one embodiment of the invention as presently contemplated, the likeness 11 of the ocean liner Titanic is structured as a hotel and the likeness 12 of the iceberg may likewise be structured as a hotel. For enhanced reality, a lake 14 is surrounding the ocean liner and the likeness 12 of the iceberg.

A subsurface, tubular person passage 13, having transparent windows 16 connects the two structures 11 and 12. The person passage enables persons using the passage to view an underwater environment with sea plants and sea animals in their own habitat, or simulated or enhanced with virtual reality effects.

Figure 2:
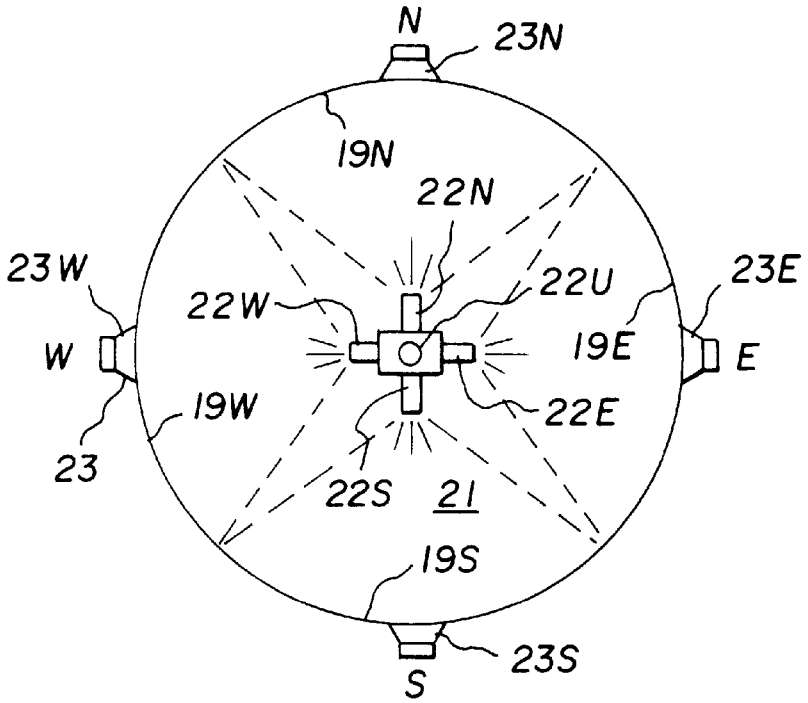
FIG. 2 is a top-down view of a viewing space showing image projection apparatus, screens and sound apparatus.
Figure 3:
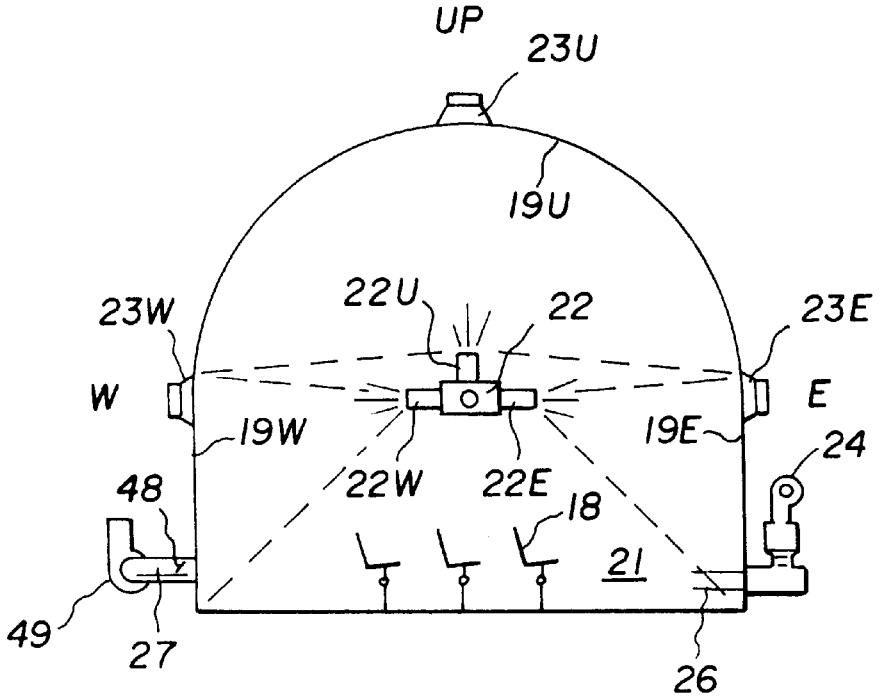
FIG. 3 is an elevation of the viewing space according to FIG. 2, further showing seating arrangement and ancillary effect apparatus.

FIGS. 2 and 3 show respectively in plan view and elevation, a viewing region generally at 21, having one or several seats 18 for viewing persons watching an enactment displayed on one or more viewing screens 19, respectively designated 19W, 19E, 19N and 19S, and an upper screen 19U. It has been found that a curved screen, e.g. screen 19W provides a more realistic view than a flat screen. A wider screen, e.g. a wide angle screen composed of screens 19W, 19N and 19S provides an even more realistic view, and a 360° angle screen additionally including screen 19E and upper screen dome 19U provides a maximum of realism, although at increased expense and complexity.

As described in more detail below, a circular screen with an upper dome screen 19U, when formed of flat, hard surfaces generates an undesirable inherent internal echo which is most pronounced in the viewing region 21. Applicant has determined that wall surfaces and screen material having soft surfaces will tend to dampen the undesirable echoes. For enhanced realism, applicant contemplates, as described in more detail below, to add to the recorded sound effects, where applicable, an artificial recorded echo, embedded in the sound signal.

At or near the center of the viewing region 21, a wide-angle image projection device 22 is located, advantageously suspended in thin cables, not shown, of which one or more cables serve to provide conductors for drive power and control signals to and from the image projection device 22.

The image projection device 22 is shown as composed of five (5) individual projectors, respectively designated 22W, 22N, 22E, 22S and 22U.

The above described arrangement of 360° projection requires high quality optical lenses in the projectors, especially when high image quality wide viewing angles are required.

As an alternative compromise, applicant contemplates that fewer projectors each projecting a less wide beam may provide a projected image of less than 360° wide angle, depending on the degree of realism and image quality desired. As another alternative, it is contemplated that the forward facing projector 22E may be arranged to project a less angle-wide, but sharper image.

Recorded sound effects synchronized with the projected images is injected into the viewing region 21 by means of loudspeakers of which speakers 23W, 23N, 23E, 23S and 23U are shown. Since a single speaker 23, within the present state of the art, is unable to provide a satisfactory wide-frequency range, it is contemplated that each speaker 23 is realized as an assembly of two (2) or more speakers each generating a sound frequency band within its own range, as well known from the art of high fidelity sound reproduction. Each of the e.g. five speakers 23 is driven from a dedicated one of e.g. five sound tracks as described in more detail below. In that manner, directed sound vectors coming from any direction, even if desired from below, can be generated for greatly enhanced realism from the five speaker assemblies 23 each derived from its dedicated sound track.

As contemplated, each speaker assembly 23 is connected to a dedicated frequency filter arrangement driven by a dedicated amplifier, each filter having an input connected to the sound track dedicated thereto.

As part of the inventive concept, the air in the viewing region 21 is continuously circulated and processed in various ways in order to provide maximum virtual realism, by means of an air treatment system seen in FIG. 3 as device 24, which injects treated air at air inlet 26, while the treated air exits at air exit 27, connected to an exit blower 49 for air pressure control.

Figure 4:
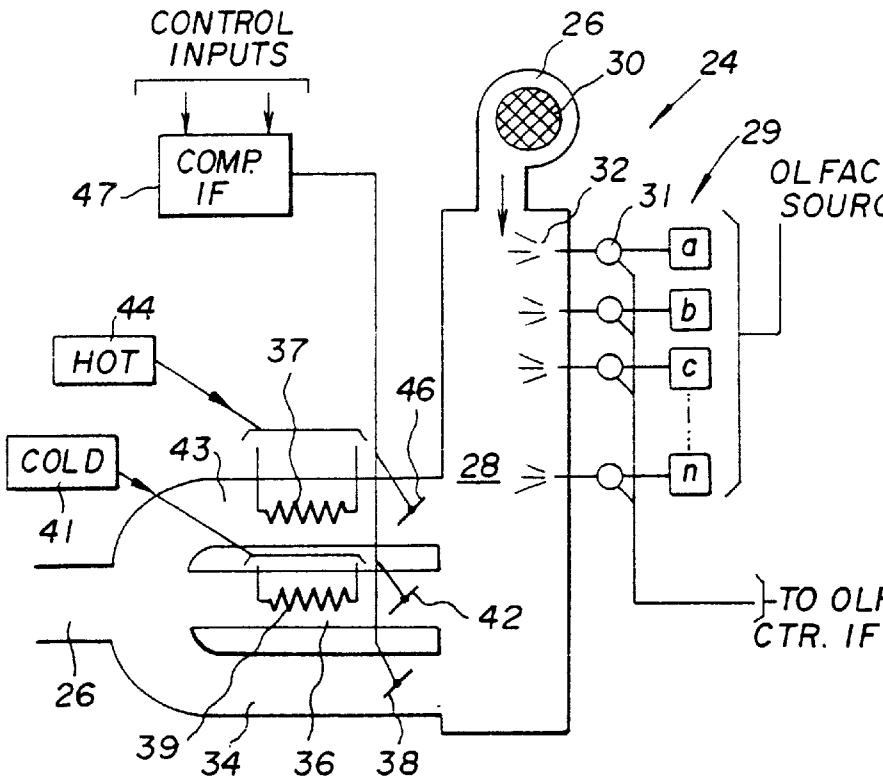
FIG. 4 is a diagrammatic view of part of the ancillary effect apparatus, including apparatus for providing olfactory effect sources and air treatment apparatus.

FIG. 4 shows details of the air processing system 24. An air blower 26 draws in fresh air through an air filter 30, from where the air flows through a plenum 28. An array 29 of containers a,b,c . . . n containing olfactory essences, preferably in liquid form, such as for example essence from flower petals to generate a pleasant landly aroma e.g., sulfur dioxide dissolved in water to indicate vulcanic activity, smells of seaweed dissolved in liquid to indicate presence of a beach, distilled water for generating a spray simulating fog at sea, and so forth, which are each connected through a small electric pump 31 to a respective spray nozzle 32 located in the plenum 28. Each pump 31 is connected to a respective output of an olfactory control interface 33, of a control system shown in FIG. 5, and described in more detail below. The olfactory system is controlled by cues embedded in a control track on a sound and control strip, as also described in more detail below.

From the plenum 28 the air passes through a manifold composed of three branches, of which branch 34 receives air directly from the plenum 28 under control of a control valve 38. Another branch 36 contains a cooling coil 39 connected to a cold water or liquid source 41 under control of a control valve 42. A third branch 43 contains a heating element 36 connected to a hot water or electric heating source, and is controlled by control valve 46. Control valves 38, 42 and 46 are also controlled by cues on the control track via the computer interface 47, connected to a digital control computer 50 shown in FIG. 5, which is ultimately controlled by instructions stored in a special effect control memory 89 as described below.

If such an instruction in the control memory signals that, for example, a cold environment is being entered, the cold control valve 42 is opened, and the viewing region 21 is suddenly filled with cold air. Conversely, if a hot environment is entered, a cue from the control memory opens the hot air valve 46, and the viewing region 21 is filled with hot air.

It is readily seen that the numerous combinations of olfactory stimuli, and combinations of different air temperatures combined with the projected wide angle moving image displays and the multidirectional sounds with superimposed echoes as described above, together are capable of providing a wide range of highly realistic impressions on viewers seated in the viewing region 21.

One further impression relating to the air flow is provided by means of air exit control valve 48 (FIG. 3) inserted in the air outflow 27 briefly mentioned above, and also controlled by the computer 50. By partially closing that valve 48 the air pressure in the viewing region 21 can be increased a small amount giving the viewers an impression of downward motion, e.g. in an airplane landing or an elevator going downward. Conversely, a suction blower 49 connected to the outlet 27 can be used to slightly lower the air pressure in the viewing region 21 will give the impression of ascending, e.g. in an airplane or elevator of the like. It follows that the valve 48 and blower 49 are both controlled by the special effect control memory 89 as described in more detail below.

Still another powerful element in further enhancing the virtual reality sensation by viewers in the viewing region is contemplated in the form of imparting physical movements to the seating facilities 18 in the viewing region 21.

Figure 8A:
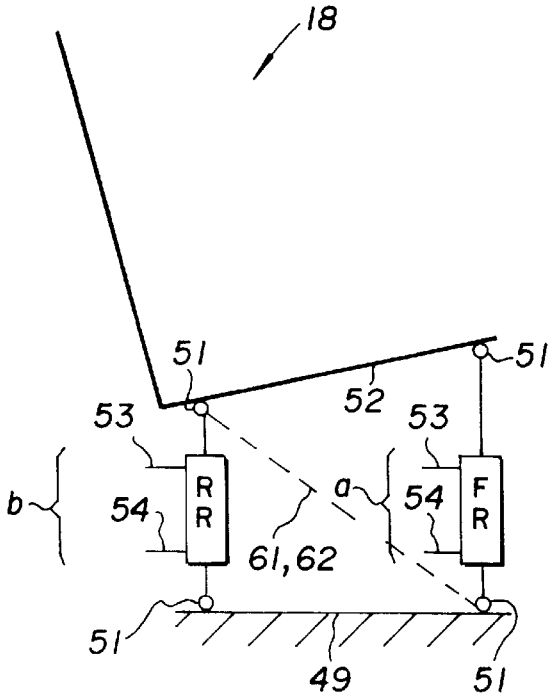
FIGS. 8*a* and *b* show respective side and front views of an active seat and activators.
Figure 8B:
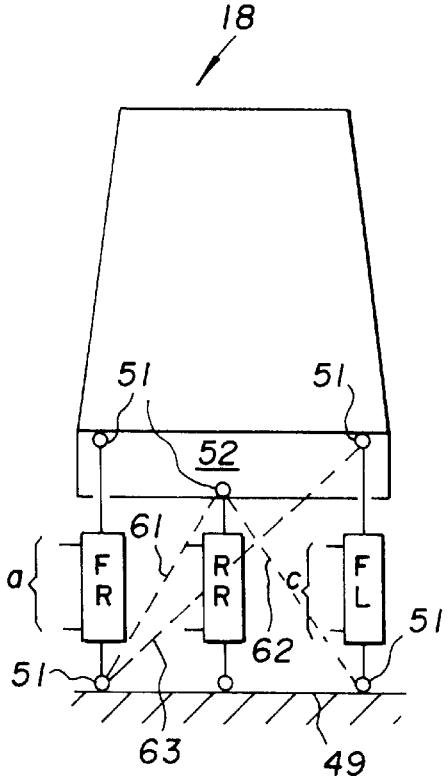

As seen in side view FIG. 8*a,* a seat 18 is seen from the right hand side, and in FIG. 8*b* from the front. Each seat 18 is connected to the base or floor by means of e.g. three hydraulic cylinders, namely cylinder RR at the rear, and two front hydraulic cylinders FR to the right hand side and FL to the left hand side of the seat 18.

Figure 9:
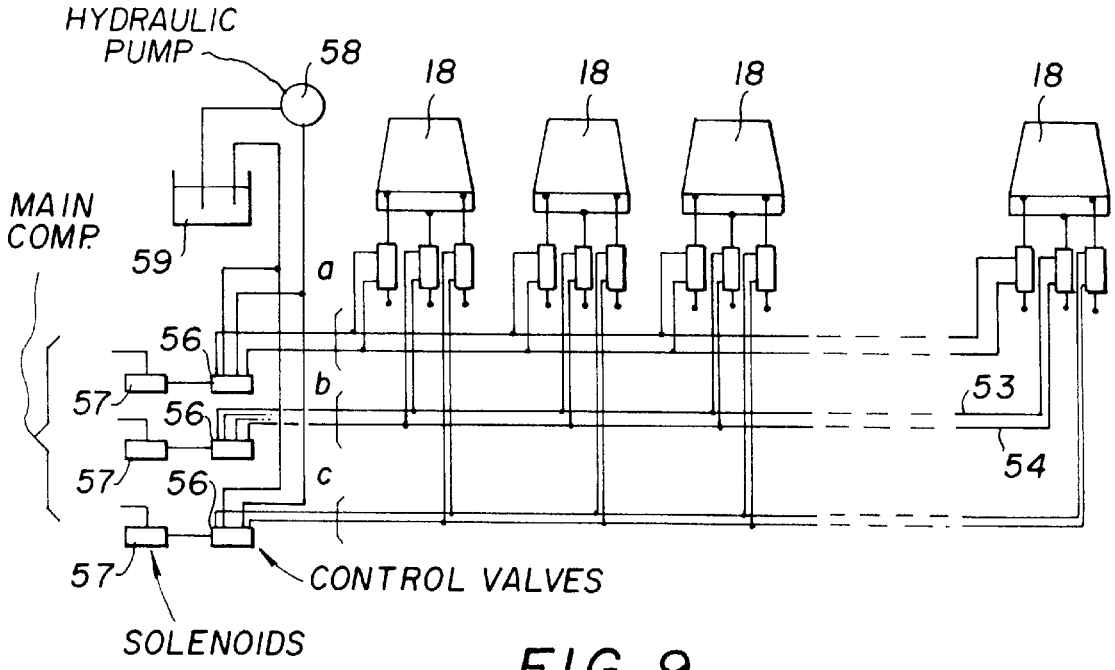
FIG. 9 is a diagrammatic view of a row of active seats and parts of the common hydraulic control and drive apparatus.

The cylinders are attached to the base e.g. floor 49 and to the underside 52 of the chair 18 by means of respective ball joints 51. A respective pair a,b,c, each composed of two hydraulic lines 53, 54 lead from each cylinder to a hydraulic control system shown in more detail in FIG. 9. All cylinders of the same designation are connected in parallel to one of a set of hydraulic control valves 56. The control valves are of the type known as proportional control valves, each proportional valve 56 having a valve spool (not shown) proportionally driven by an electric solenoid 57. The control valves are all connected in conventional manner to a common hydraulic pump 58 and a hydraulic tank 59 containing the hydraulic fluid that circulates through the system. The solenoids 57 are all connected to a seat control interface 84 of the computer 50, which drives the control valves 56 with proportional control voltages as directed by instructions stored in the special effect memory 89.

Since the hydraulic cylinders are joined to the chairs and the base by means of ball joints 51, it follows that each chair has too many degrees of freedom of movement in order to retain its position and that therefore some further restraints must be added to each chair. Such restraints can be added in the form of links shown in dashed lines in FIGS. 8*a* and 8*b*. Two links 61, 62 connect the upper ball joint 51 of the rear cylinder RR with respective lower ball joints 51 of cylinders FR and FL, and an additional link 63 connects the upper joint of cylinder FL with the lower joint of cylinder FR. With this linkage, the hydraulic control is capable of moving all chairs 18 in unison in numerous ways under control of control valves 56, which are in turn controlled by the solenoids 57, connected to the system's main control system shown in FIG. 5 in response to cues embedded in the special effects control memory 89 as described in more detail below.

In regard to the hydraulic chair control system it should be noted that the chair backs are shown upward tapered which allows adjacent chairs more sideways freedom, and the chairs can therefore be placed more closely together for more efficient use of the available seating space.

Since hydraulic cylinders may have minute leakage around the piston or shaft seals, all chairs can from time to time be reset by raising them all, when not occupied, to e.g. the top position, and then lowered to halfway down. Alternatively one or more chairs may have a halfway position switch (not shown) indicating if the chair is out of position. It follows that the chairs can be combined in twos or threes or more, each combination sharing one or two sets of hydraulic cylinders.

Figure 6:
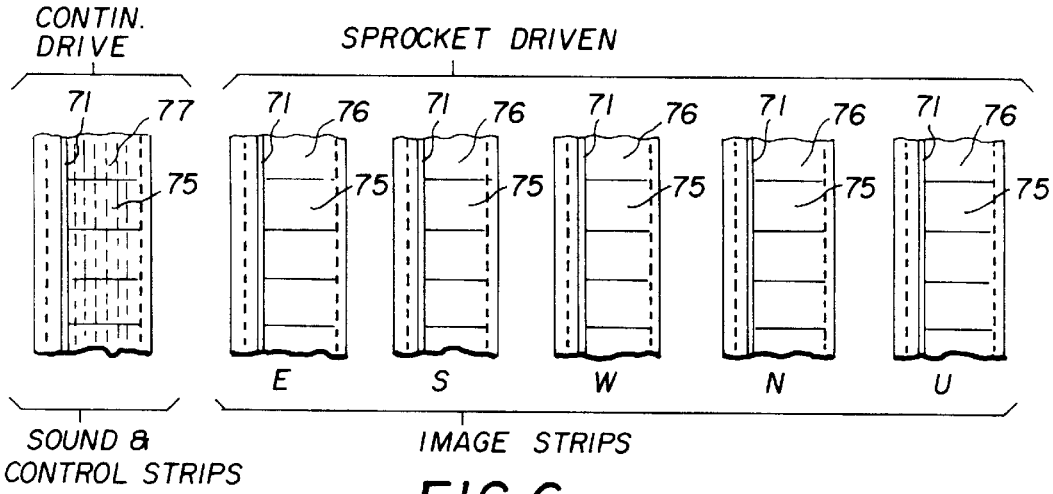
FIG. 6 is a diagrammatic view of five (5) image strips each having sprocket holes, a digital image frame ID-number track, and a combined sound and control strip.
Figure 7:
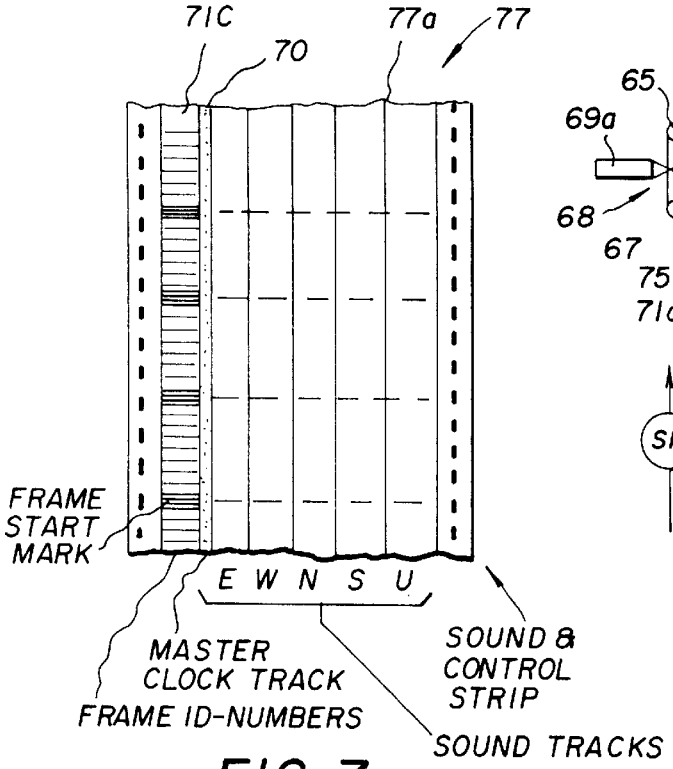
FIG. 7 is a diagrammatic view of details of the sound and control strip, showing five sound tracks, a master clock track and a frame ID-number track.

Referring now to FIGS. 6 and 7, the image strips, and the control and sound strip will be described in more detail.

In a conventional projection system, the image projector has an image strip disposed on a film drawn from a film feeding cartridge to an uptake cartridge in conventional manner. A conventional film strip conventionally has to one side a narrow sound track next to the image track which occupies the greater part of each image frame of the film. The film images are drawn by a stepping mechanism, one image frame at a time, through an optical illumination and lens system to be displayed on a screen in conventional manner. Since the sound track must be read in continuous motion a loop of the film strip before or behind the stepping mechanism is provided so that the sound track can be scanned in continuous motion, while the image frames are displayed one at a time in rapid succession so as to create a projected image visually appearing as a continuously moving action.

The present system contemplates at least one but preferably a plurality of separate image strips each to be displayed by respective image projectors 22E, 22S, 22W, 22N and 22U if a completely circular and upward projected image is to be provided. As seen in FIG. 6, this figure shows for example five image strips 76, each to be projected by a respective projector. In accordance with the inventive concept, each image strip carries a sequence of image frames, wherein, according to the inventive concept, each image frame has a frame identity number FRID which is recorded as a binary number on a FRID track 71 next to the image frame track 76. A typical projector 22 is shown in diagrammatic form in FIG. 10 showing a type as contemplated for use in the present invention.

Figure 10:
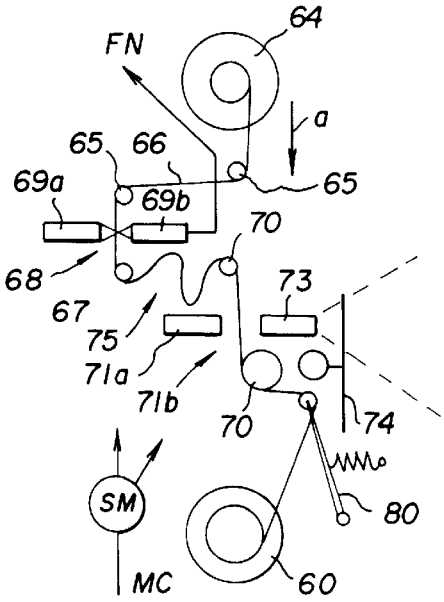
FIG. 10 is a diagrammatic view of a film strip drive for a single strip.

In FIG. 10 a feeding spool 64 feeds a film strip 66 supported by idler wheels 65 is drawn continuously in direction shown by arrow "a" by a continuously driven sprocket wheel 67, through a light scanner 68 composed of a light source 69*a,* and a light detector 69*b* which reads a light spot on a frame identity number track 71 on an image track 76 (FIG. 6). Next, the film strip forms a slack loop 75 before it reaches a step-driven sprocket wheel 70, which feeds the film strip one image at a time past illumination optic 71, composed of an image illuminator lamp 71*a* and projection optics 73. A spring-loaded idler arm, 80 maintains the film in straight form before it is spooled onto an uptake spool 60. A polarizing screen 74 may be placed at the output of the optics 73, in order to project the images in polarized form, if 3-D imaging by means of polarized images are to be used, as described below. A synchronous drive motor SM drives the projector.

A projection system as used in the presently contemplated embodiment of the invention includes a plurality of at least two image projectors of the type described above. In order to maintain synchronism between the projectors it is possible and known to apply mechanical linkage between the drive components. Mechanical linkage, although simple in concept, has the drawback that if one film strip should slip in the drive mechanism the images will be out of synchronism, and the performance must be stopped until the strips are again aligned manually.

The present invention contemplates and discloses a multiple film drives by means of dedicated electric synchronous motors with an automatic synchronization arrangement which quickly automatically re-synchronizes an out of sync film strip, which will most often hardly be noticed by viewers.

In accordance with the inventive concept as briefly mentioned above, FIG. 6 shows a plurality of image strips 76. Each image strip 76 shows in conventional manner all the images which in succession form the animation of a respective display. As contemplated, each strip 76 is projected frame by frame by its dedicated projector as described above. It follows that a bank of projectors 22 may share some common components such as spool magazines, power supplies, synchronizing controls, etc., the latter to be described in more detail below.

FIG. 6 shows a number of image strips E, S, W, N and U, the number depending on the number of simultaneous displays chosen for a performance. In order to keep all image tracks in synchronism, each image strip includes a frame number identity FRID track 71 that holds digital information formatted for keeping all image strips in synchronism with each other and with a sound and control strip 77, FIG. 7.

The synchronizing, i.e. sync. track 71 on all strips 76, 77, contains in binary code a binary number that is incremented by 1 (one) for each next image frame, and such that the corresponding frames on all the image strips 76 and on the sound and control strip 77 are all marked with the same binary number. This binary number, which is the same for all corresponding frames 75 on all strips is used by an electronic control described below to maintain all strips in synchronism.

The sound and control strip 77, seen in FIG. 6 and FIG. 7, is run on a strip drive similar to the image strip transport shown in FIG. 10, but without the image projection components. The sound and control strip 77 has no image tracks, but has a plurality of sound tracks, 77*a,* namely one for each image strip E, S, W, N and U. In addition, the sound and control strip 77 has a master clock track 70 and a frame master identity number track 71*c*.

In a multidimensional projection system as disclosed herein it is important that all image strips E, S, W, N, U and the sound and control strip SC are in perfect synchronism, or else the images will not overlap with precision and the sound effects from different directions will not be in sync with the images, causing a very unsatisfactory presentation. It is therefore an aspect of the present invention to provide an automatically acting synchronization arrangement that maintains all strips in perfect synchronism.

Synchronism is maintained by means of a digital frame code FRID imprinted for each image frame on the master sync track 71*c* on the sound and control strip 77, and on each image strip on the corresponding image frame. A master clock track 70 runs in parallel with the FRID track.

As presently contemplated the digital FRID signal will be in binary form, advancing by a count of one for each new image frame in the forward direction of the image presentation. Numerous formats are available for the binary number. The well-known ACSII format using a start bit for each image frame, but having a bit number at least as large as is required to accommodate the largest number of image frames of an entire performance, is presently contemplated.

Figure 11:
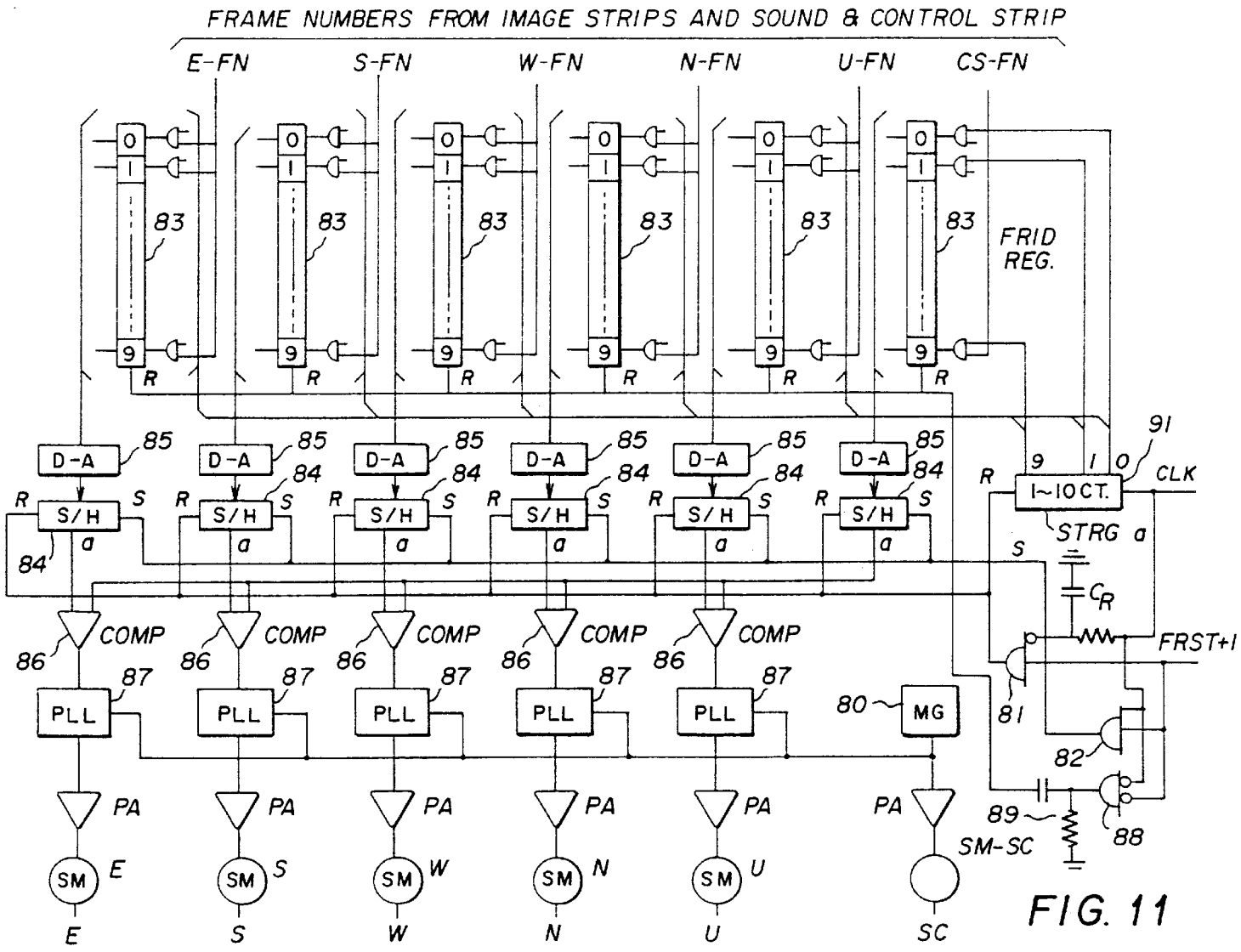
FIG. 11 is a schematic block diagram of a control arrangement for maintaining several sprocket-driven strips in synchronism.

A motor drive arrangement that automatically maintains perfect synchronism between all strips is part of the inventive concept and is shown in block diagram FIG. 11, wherein a synchronous drive motor SM is provided for each projector including the master drive motor SM-SC for the sound and control strip, which is driven by a constant master frequency generator MG at a strip speed in terms of frames per second selected for the system.

The electronic system for maintaining all strips in synchronism receives the continuously advancing frame ID numbers from all image strips on respective frame number leads E-FN . . . CS-FN and converts the frame numbers in respective digital-to-analog converters D-A to analog dc voltages corresponding to the respective frame identify numbers FRID.

Figure 11A:
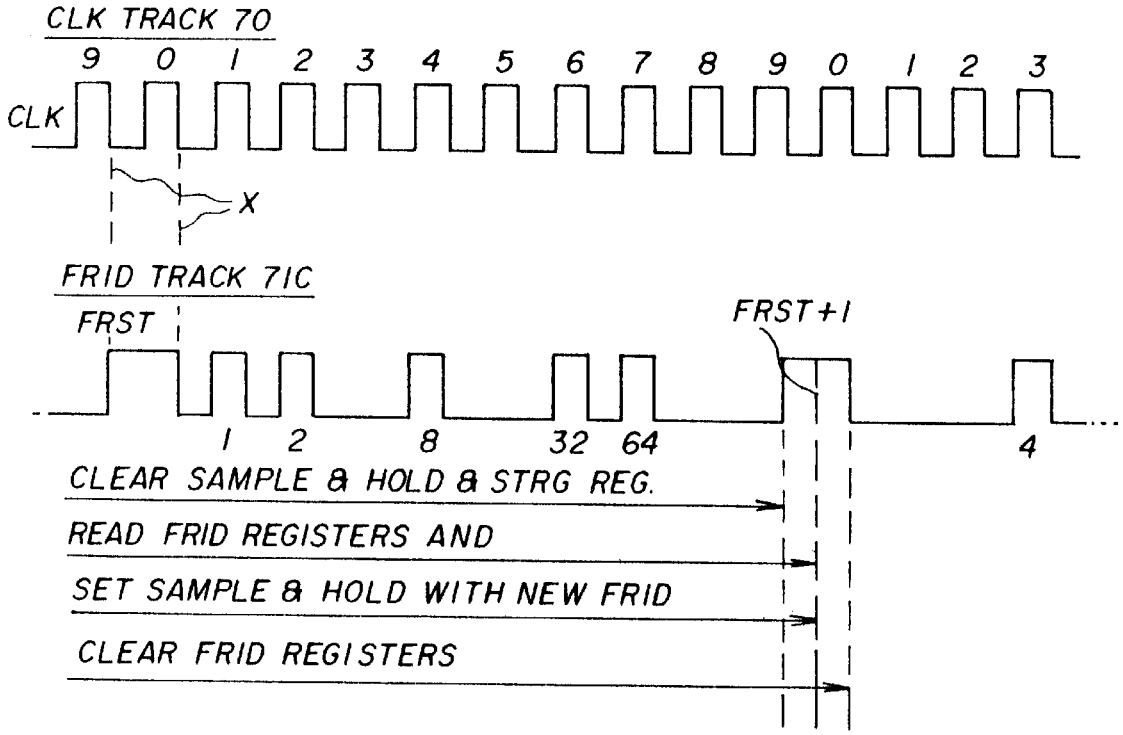
FIG. 11*a* is a timing diagram showing clock pulses, frame start pulses and frame I-D address pulses.

The process of determining the frame ID numbers FRID for the moving strips is shown in more detail in FIG. 11*a,* wherein the systems' clock pulses obtained from reading the master clock track 70 on the sound and control strip 77, shown as CLK in FIG. 11*a,* are obtained from scanning clock track 70 on this strip 77 with scanner 68 in FIG. 10. It should be noted that FIG. 11*a* shows, for the sake of simplicity, a relatively small number of clock pulses, i.e. ten (10) pulses for each frame which will not suffice in a practical setup, since the ten pulses will only allow a maximum frame count of $2^{10}$, which equals 1024 frames. A practical system would require a larger number of bits per frame according to the actual duration of a performance, as mentioned above.

Referring now to FIG. 11*a,* each frame starts with a frame start pulse FRST (FIG. 11*a*) which has a duration of two times the duration of one clock cycle, namely the clock pulse and a clock space as indicated by two vertical dashed lines x. At the end of a frame, e.g. the frame shown in track FRID (Frame Identity), between an arbitrarily chosen frame start pulse FRST and a following frame start pulse FRST+1 it is seen, as an example, that this frame has a binary ID number equal to the sum of bit values 1, 2, 8, 32 and 64 which equals a frame ID number equal to 107. At the beginning of the text frame start pulse FRST+1 a "clear sample and hold" gate 81, FIG. 11, generates a reset signal created from the Boolean function [CLK]×(FRST+1) (brackets indicate logic inversion) i.e. "absence of a clock pulse" and "presence of frame start pulse FRST+1". This reset signal is used to clear the sample and hold circuits S/H at reset terminal R of the analog value of the previous frame ID, and also resets steering counter STRG at terminal R. Next the following frame identity FRID values, now stored in the FRID registers 83, which are present at the output of the D-A circuits 85 are entered into the S/H circuits 84, which are set with a "Read FRID REGISTERS" pulse created as a function [CLK]×(FRST+1) (brackets indicate logic inversion) in gate 82 applied to the set terminal S of the sample and hold circuits SH. These registers were set with the last frame ID number during the previous frame under control of a steering register STRG, which is driven by clock pulses CLK.

Next the analog voltage of each image frame representing its respective FRID value is compared with the analog frame number voltage FRID from the control and sound strip CS-FN in respective analog comparators COMP 86.

At the end of the FRST+1 pulse the FRID registers are all cleared at their R terminal by an output pulse from circuit 88 having as inputs an inverted clock pulse CLK and an inverted frame start pulse FRST+1. The length of the output pulse of circuit is limited by an RC circuit 89, so as not to interfere with the next arriving frame identity pulses of the following frame. These next arriving frame identity pulses are steered into the proper positions in the FRID registers by the steering counter STRG 91*a* and the process described above to assure that all synchronous motors SM are maintained in the same phase, so that all images and virtual reality effects are maintained in synchronism.

The dc-output of each comparator is for practical reasons "smoothed" out in a low-pass filter, not shown for the sake of simplicity, and connected to the dc-control input of a respective phase-locked loop PLL 87, in which it is combined with the internal dc-control for the internal voltage-controller oscillator in the PLL, which aids the PLL to respectively advance or retard the trailing or advanced strip until it is again in sync with the SM-SC drive.

It is to be understood that the process of maintaining all strips in sync could be preformed by other means, such as e.g. mechanical coupling between all projector drives, which could, however, lead to a cumbersome mechanical arrangement. Furthermore, this mechanical arrangement would not solve problems arising if one of the strips should slip in its respective sprocket drive, which happens from time to time.

As described above, each image strip E, S, W, N and U has at one side a frame identity track ID which represents each frame by a continuously incrementing binary frame number as the images are projected. The control circuit of FIG. 11 maintains all image strips in the same image phase as the sound and control strip SC. The frame numbers serve an additional important purpose, namely that of controlling the various virtual reality effects described above, such as e.g. the air temperature, the olfactory effects and the movements of the seats, etc. In order to perform these controls, the frame identity numbers described above, which serve to maintain synchronism between all strips at the same time, also serve as address numbers transmitted to a computer 50 for activating the various effects that are invoked and controlled by the digital control computer 50 shown in FIG. 5.

Figure 5:
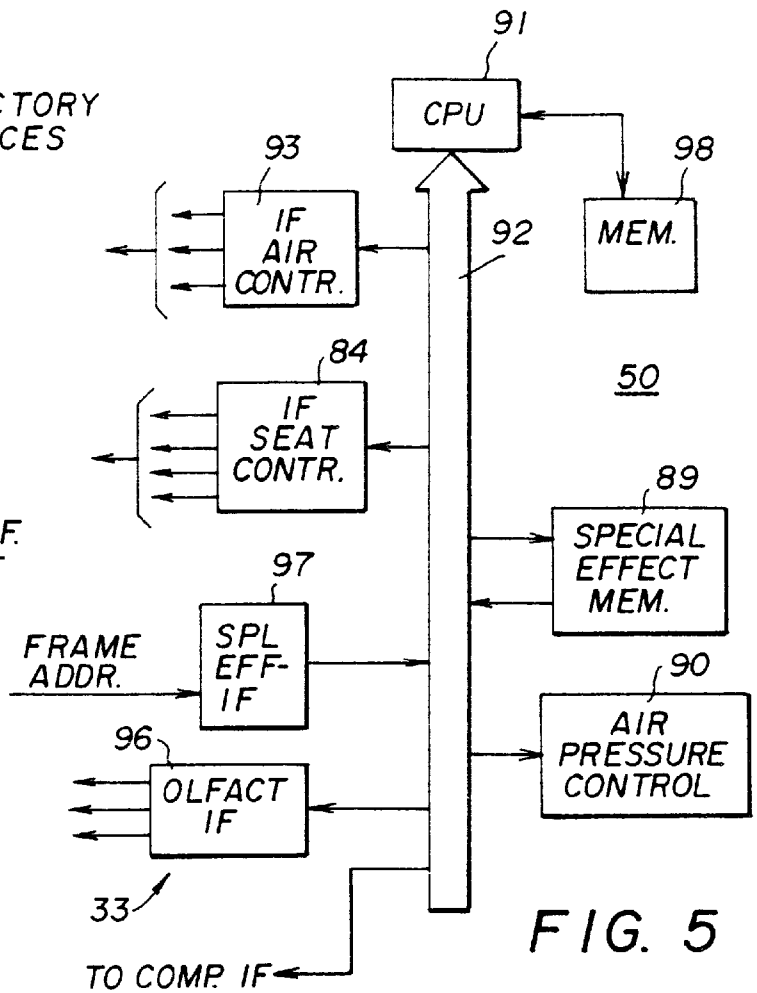
FIG. 5 is a block diagram of a control computer with various virtual reality effect control interfaces.

The digital control computer 50 shown in FIG. 5 includes a central processing unit CPU 91 of conventional construction, connected to a digital control bus 92, which communicated with a number of interfaces that translate digital instruction on the bus 92 to analog control signals, such as the air control interface 93, the seat control interface 84, and the olfactory control interface 96, in response to specific frame addresses arriving at the special effect interface 97.

Figure 12:
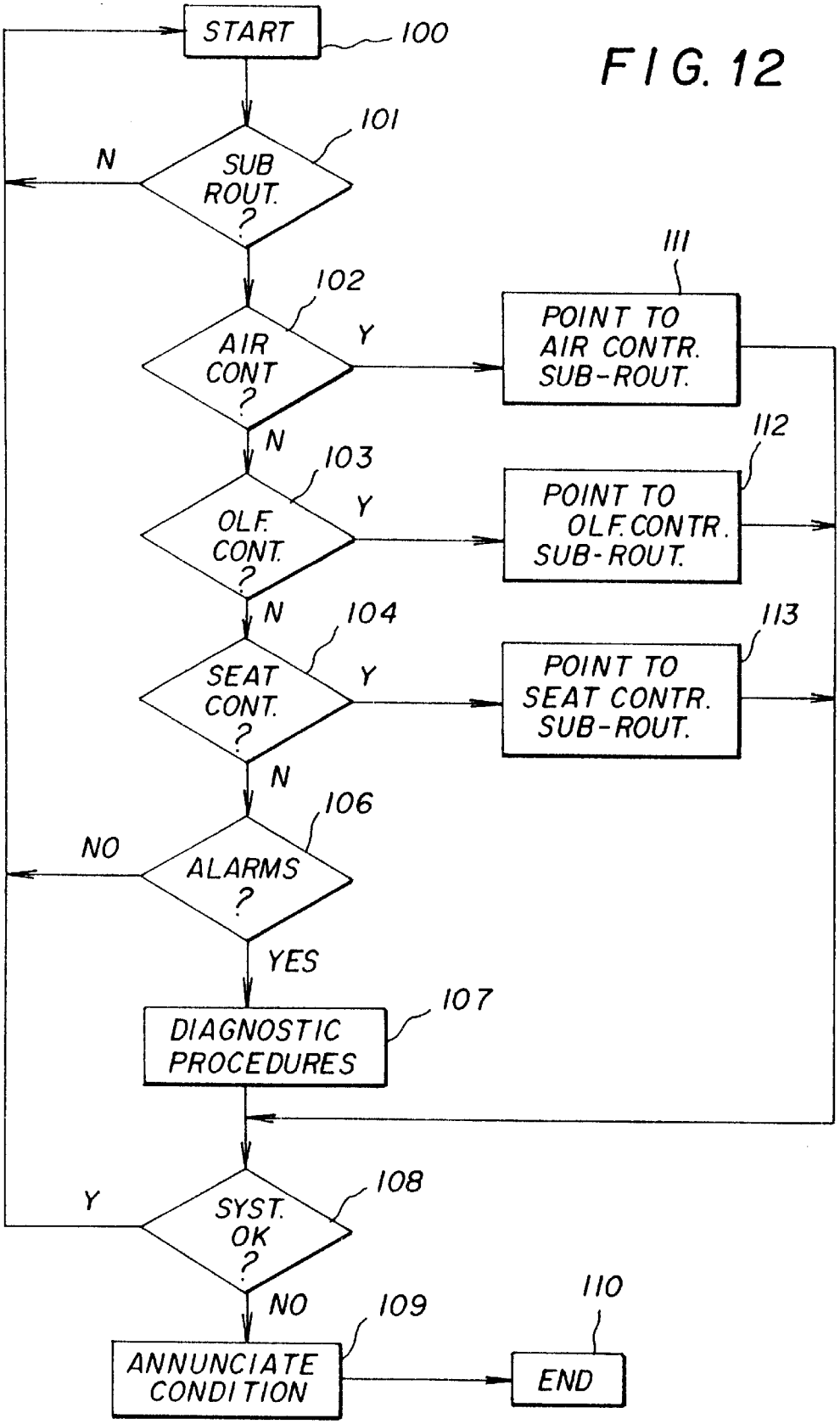
FIG. 12 is a flow chart showing major steps of the overall control process.

During operation, the frame addresses are continuously in sequence presented to the special effects interface SPL-EFF 97. Whenever a frame address is at a given FRID count, marked as an effects count requiring special effect to be generated, as marked in computer memory 98, the computer CPU 91 "points" to a location in the special effect memory 89, which in turn activates a corresponding subroutine or subroutines as shown in the flow chart of FIG. 12. The computer responds with control signals to perform the responses programmed into the special effect memory 89 for the corresponding subroutines. This is a very powerful feature that enables the system to execute single special effects or combinations of simultaneous effects, in that special effect subroutines can be prepared in advance by frame ID numbers ahead of the times that the effects are to be executed, and triggered into action by a subsequent trigger frame FRID number. If, for example, an impact event is to be performed, several subroutines can be assembled in advance in the special effect memory 99, such that concurrent effects, e.g. motion of chairs, olfactory effects, etc. and released simultaneously on subsequent cues issued at certain preset image frame identity numbers. A virtually limitless range of special effects can be combined and released in response to instructions coordinated with the image frame ID numbers.

The invention is capable of presenting a performance in 3-dimensional format by means of various methods for selectively addressing a viewers eyes in mutually exclusive formats. Such formats are known e.g. as respective presentations with polarized images viewed through goggles having polarized lenses, or by means of goggles having liquid crystal lenses being alternately activated by appropriate electric controls.

If 3-D presentation is performed by means of polarized images, a projector as shown in FIG. 10 may have a rotating screen 74 in front of the projection optics 73, wherein the polarizing screen has alternating filters with 90° angle polarization, synchronized with alternating image frames in 3-D format. If liquid crystal lenses are to be used, an electric signal can be transmitted (by wire or wirelessly) to each set of goggles to alternatingly view the 3-D images from a projector which, as above, alternatingly transmit the 3-D images in synchronism with the activation of the lenses of the goggles.

In accordance with a feature briefly mentioned above, the invention is well suited to provide a presentation with enhanced echo effects. Enhanced echoes effectively add to the realism of a presentation when judicially applied.

In order to apply enhanced echoes, it is important that the viewing space is arranged with inherent echo dampening since the inherent echoes generated due to internal sound reflections in the viewing space are confusing the hearing senses of a viewer. In order to reduce or eliminate inherent echoes it is contemplated to apply sound-absorbing elements in the viewing room. Such sound absorbing elements can be applied by means of sound-absorbing surfaces not used for image presentation, and further by means of projection screens that are, besides being light reflecting, also sound absorbing. Such screens can be formed as a two or more layers of screen material having a front woven layer of thin white fabric attached to one or more rear layers of thick felt-like fabric.

Figure 13:
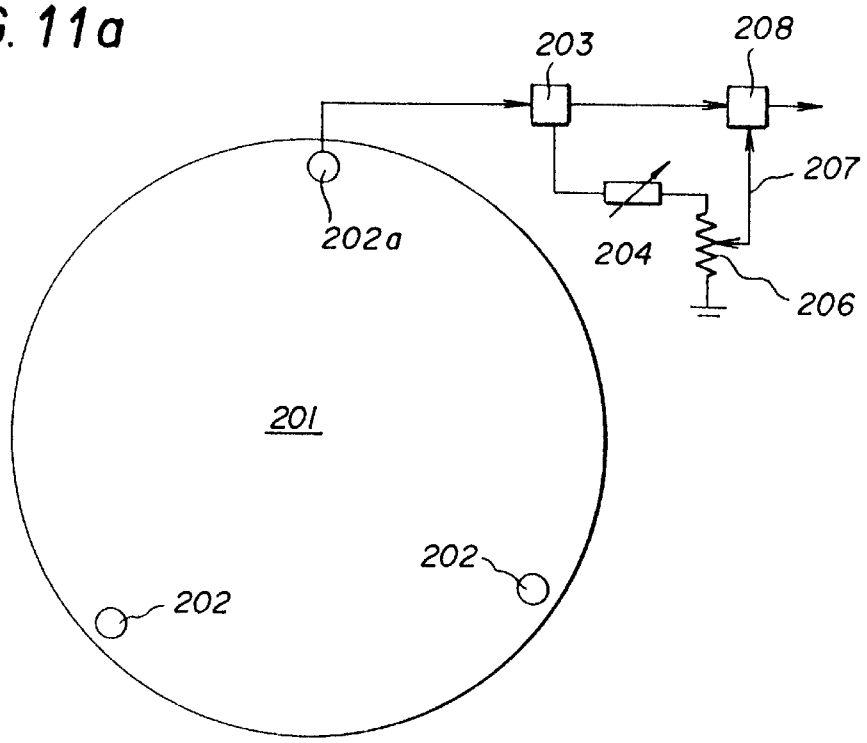
FIG. 13 is a diagram showing generation of enhanced echoes.

For enhanced echo generation, it is known to couple delay components to sound recording apparatus. FIG. 13 shows a recording stage 201 with e.g. 3 sound recording microphones 202 of which at least one microphone, 202*a,* is equipped with echo generating apparatus, having a preamplifier stage 203 with an output coupled to a variable delay line 204. An output from that delay line coupled to a variable attenuator 206 having a variable output 207 coupled to a mixing stage for generating echoes of variable delay and intensity.

It is to be understood that the sound tracks and the frame identity number track will be scanned simultaneously in continuous motion of the track, as opposed to the image frames, that are advanced in step motion. It is therefore necessary that the frame identity numbers on the sound track are offset from the corresponding image frames a few frames in order to maintain synchronism between sound and the corresponding image frames.

I claim:

1. A method and elements for enacting an ocean sail of a ship using elements of virtual reality, the elements including visual image presentation means for enacting the ocean sail having cues digitally embedded therein, a first structure having the likeness of a ship, a second structure having the likeness of an iceberg, and a body of water adjoining said first and second structures, the method which comprises the steps of:

enacting the likeness of the ship departing a port of embarkation;

enacting the likeness of the ship crossing the body of water;

enacting the likeness of the ship impacting the likeness of the iceberg;

enacting the likeness of rescue efforts;

beginning the formation of at least one of the elements of olfactory and tactile air pressure and temperature virtual reality in response to cues digitally embedded in said visual image presentation means;

and further including the steps of presenting said element of virtual reality at predetermined times after said cues.

2. The method according to claim 1, including the step of forming the element of olfactory virtual reality by means of air-moving apparatus synchronized with said visual image presentation means by certain of said cues, and drawing said air from smell-generating sources.

3. The method according to claim 1, including the step of forming the element of temperature virtual reality by means of air-moving apparatus synchronized with said visual image presentation means by certain of said cues, and drawing the air from air-heating and air-cooling sources.

4. The method according to claim 1, including the steps of providing seating means for at least one person to view said enacting steps, initiating the agitating of said seating means by means of cues digitally embedded in said visual image presentation means, and producing the agitating of said seating means at predetermined times after said cues.

5. The method according to claim 1, further including the step of enacting a dive to the sunken ship.

6. Apparatus for providing elements of virtual reality for enactment of a sail, comprising:

a first structure having a likeness of a ship;

a second structure having a likeness of an iceberg;

a body of water adjoining said first and second structures for creating a likeness of the ship crossing said body of water;

a film strip carrying a sequence of image frames depicting said enactment of a sail, each image frame having a distinct frame identity number embedded in said image frame, said film strip also carrying digitally embedded cues at certain of said image frames;

wide angle image projection apparatus for projecting from said film strip wide angle images for said enactment of a sail;

sound projection apparatus for creating sound elements of said virtual reality in at least two directions, synchronized with said image projection apparatus;

means for initiating the creation of olfactory elements of said virtual reality by certain of said cues on the film strip and for delivering said olfactory elements at predetermined times after said cues to synchronize said olfactory elements with said image projection apparatus;

means for initiating the creation of hot air and cold air by certain of said cues on the film strip and for delivering said hot air and cold air at predetermined times after said cues to synchronize said hot air and cold air with said image projection apparatus;

wide angle screen means juxtaposed with said wide angle projection apparatus for displaying said wide angle images, said wide angle screen means having a focal region within view of said projected images; and seating means disposed in said focal region for seating viewers of said images, said focal region being exposed to said elements of virtual reality, including said olfactory elements, and said hot air and cold air; and including in said seating means control means coupled to said seating means for controlling positions of said seating means, said seating control means being responsive to certain of said cues on the film strip.

* * * * *